United States Patent [19]

Hasegawa

[11] 4,427,299

[45] Jan. 24, 1984

[54] ELECTRONIC DEVICE WITH AN ALARM FUNCTION

[75] Inventor: Minoru Hasegawa, Kodaira, Japan

[73] Assignee: Casio Computer Co., Ltd., Tokyo, Japan

[21] Appl. No.: 483,416

[22] Filed: Apr. 11, 1983

Related U.S. Application Data

[63] Continuation of Ser. No. 197,270, Oct. 15, 1980, abandoned.

[30] Foreign Application Priority Data

Oct. 22, 1979 [JP] Japan ..... 54-146027[U]
Dec. 11, 1979 [JP] Japan ..... 54-171453[U]

[51] Int. Cl.[3] ..... G04B 19/24; G04B 23/02

[52] U.S. Cl. ..... 368/29; 368/73; 368/261

[58] Field of Search ..... 368/28–30, 368/72–74, 243, 245, 250–251, 261

[56] References Cited

U.S. PATENT DOCUMENTS

| | | | |
|---|---|---|---|
| 4,060,973 | 12/1977 | Martino | 368/245 |
| 4,104,865 | 8/1978 | Sasaki | 368/251 |
| 4,276,541 | 6/1981 | Inoue et al. | 368/108 |
| 4,279,029 | 7/1981 | Oda et al. | 368/251 |
| 4,301,524 | 11/1981 | Koedd et al. | 368/251 |
| 4,303,996 | 12/1981 | Schmitz | 368/82 |

*Primary Examiner*—Vit W. Miska
*Attorney, Agent, or Firm*—Frishauf, Holtz, Goodman & Woodward

[57] ABSTRACT

An electronic device with an alarm function has a time count circuit for providing time data and a date count circuit for providing date data. The electronic device also produces an alarm sound at an alarm time. When the date data represents a specific day, the electronic device produces a melody different from the alarm sound to tell the specific day.

10 Claims, 9 Drawing Figures

ELECTRONIC DEVICE WITH AN ALARM FUNCTION

This application is a continuation of application Ser. No. 197,270, filed Oct. 15, 1980, now abandoned.

BACKGROUND OF THE INVENTION

The present invention relates to an electronic device with an alarm function to tell a specific day.

Recently, various electronic devices with an alarm function have been developed and marketed. Of those electronic devices, an electronic timepiece has an alarm function (time alarm) for telling a preset time and another alarm function 9 (calendar alarm) to tell a specific day. The calendar alarm is so designed that when the calendar data reaches a specific day, a calendar alarm display member is lit or flashed to tell that the calendar data reaches a desired date, or desired month and day.

In a timepiece with an extremely restricted display area such as a wrist watch, the calendar alarm display member is small by necessity. Therefore, the display member fails to provide an effective visual appeal. The result is that an operator frequently fails to see the displayed date or mistakes it for the other.

In connection with the calendar alarm, the preset data are often private data such as birth day and an apointed day. In our daily life, however, the alarm function is frequently needed for specific days common for everybody, for example, Christmas and other holidays. In the electronic timepiece currrently marketed, the specific day, even the days common for everybody, must be loaded into the memory circuit by means of external operating means. This manipulation is troublesome for the operator.

Accordingly, an object of the present invention is to provide an electronic device with an alarm function which can effectively issue an alarm when date data reaches a preset specific day.

Another object of the present invention is to provide an electronic device with an alarm function to tell a specific day if the specific day such as a holiday is not preset.

SUMMARY OF THE INVENTION

To achieve the above objects, there is provided an electronic device with alarm function comprising: time count means for counting a reference clock signal to provide time data; date count means for counting a one-day signal produced from the time count means to provide a date data; alarm signal generating means for producing an alarm signal when the time data from the time count means reached alarm time; first alarm sound producing means for producing a first alarm sound on the basis of an alarm signal produced from the alarm signal producing means; means for detecting that the date data of the date count means reached a specific day; and second alarm sound producing means for producing a melody as an alarm sound different from the first alarm sound at the alarm time when the specific day detecting means detects the specific day.

With such an arrangement, the electronic device of the invention may be effectively tell the specific day.

Other objects and features of the present invention will be apparent from the following description taken in connection with the accompanying drawings.

DETAILED DESCRIPTION

Figure 1A:
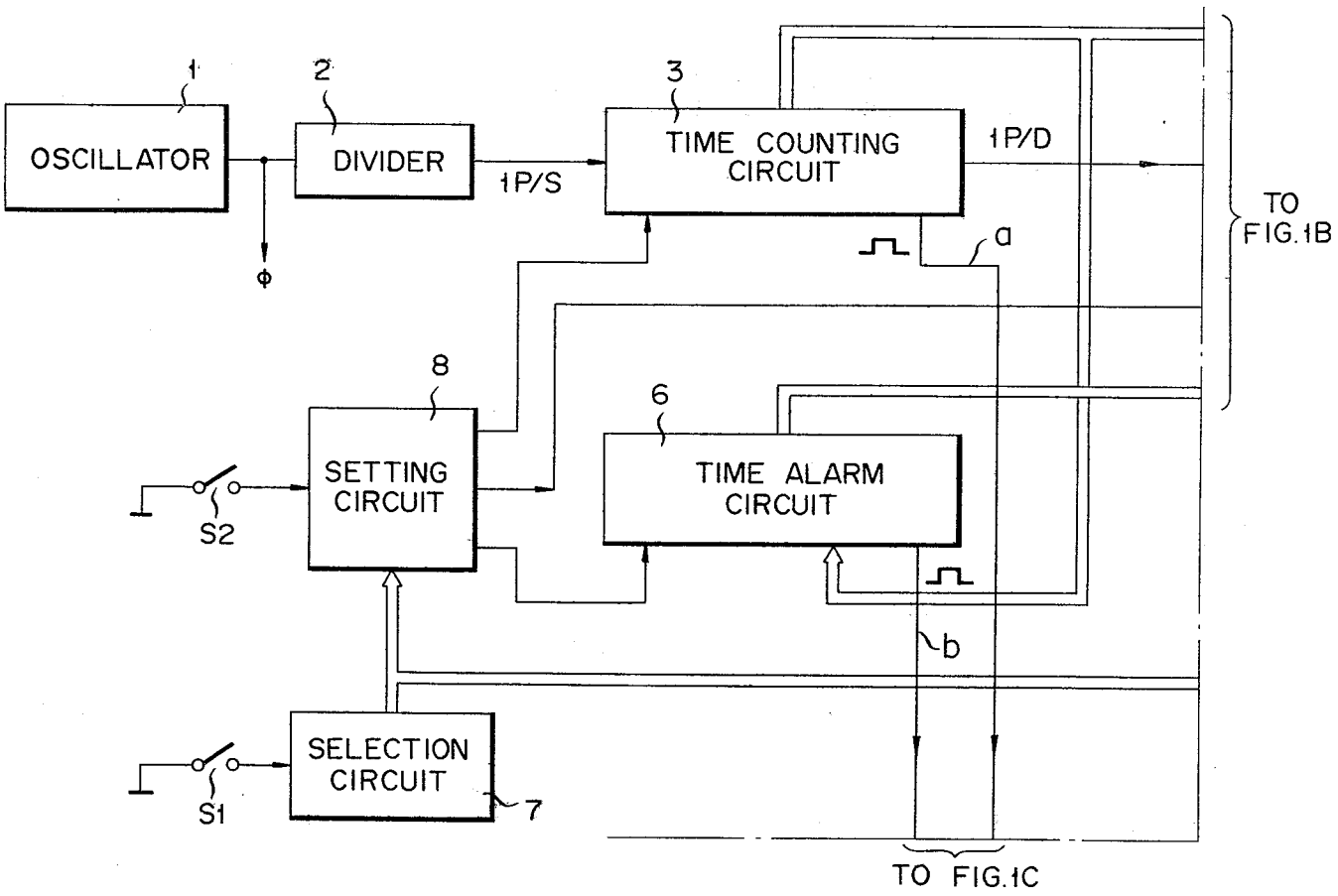
FIGS. 1A to 1C cooperate to form a circuit arrangement of an electronic timepiece to which the present invention is applied.
Figure 1B:
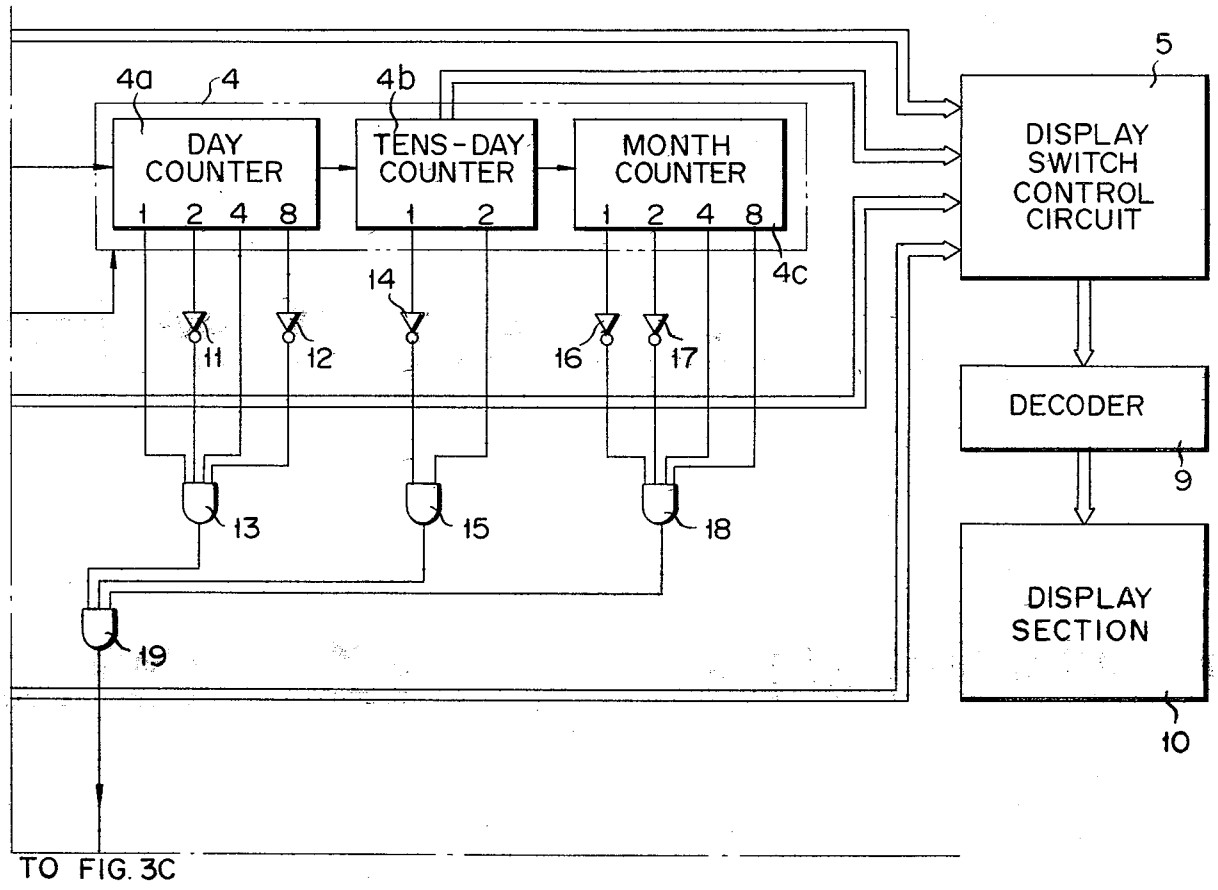
Figure 1C:
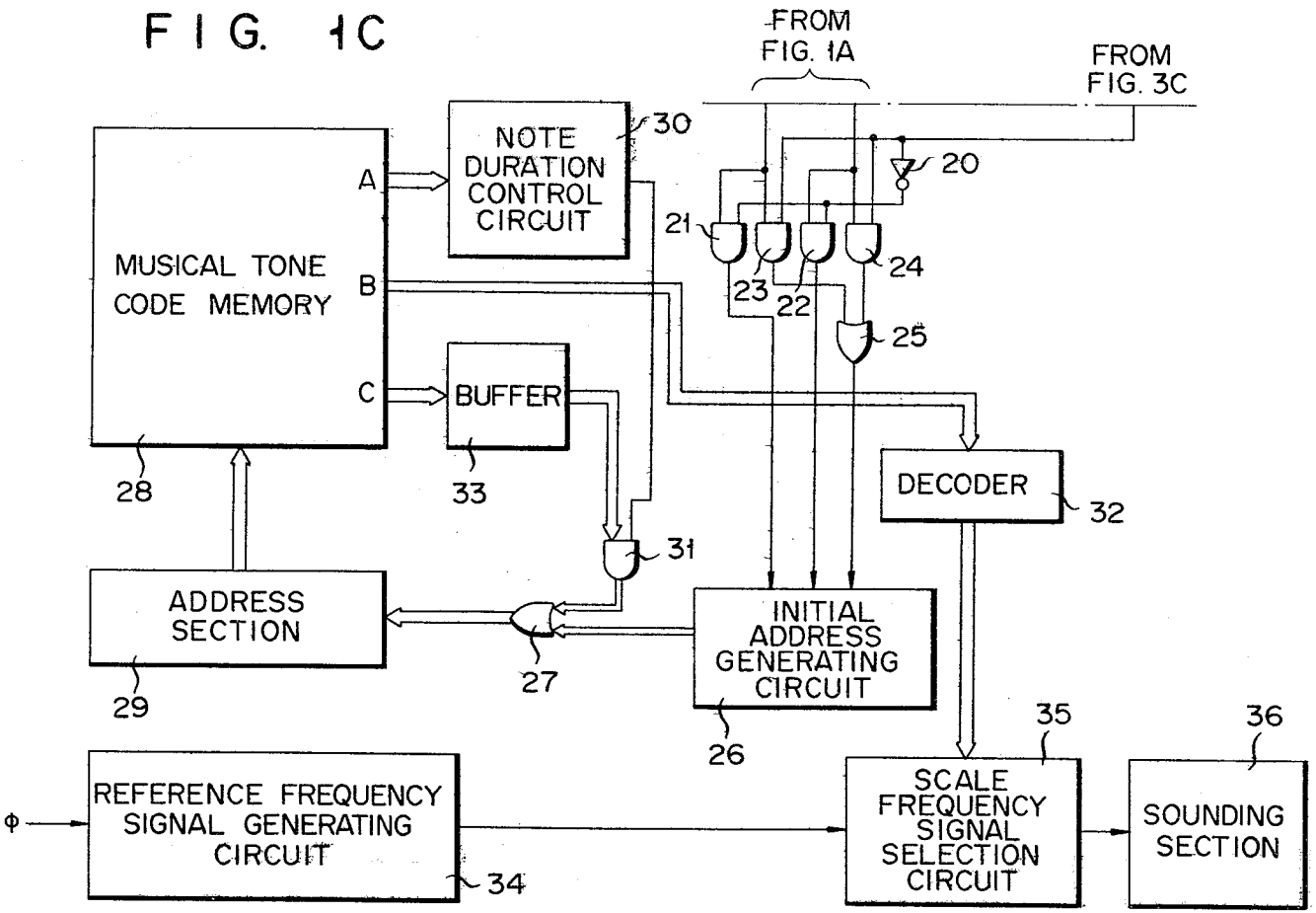

Referring to FIGS. 1A to 1C, there is shown a circuit arrangement of an electronic timepiece to which the present invention is applied. In the figures, an oscillating circuit 1 oscillates a reference frequency signal which is in turn applied to a frequency-dividing circuit 2 where it is frequency-divided into a signal (1 P/S) of one-second period. The one-second signal is then applied to a time count circuit 3. The time count circuit 3 sequentially counts seconds, "minutes" and hours on the basis of the one-second signal and applies a carry signal (1 P/D) of 24-hour period to a calendar count circuit 4. The time data derived from the time count circuit 3 is supplied to a display switch control circuit 5 and a time alarm circuit 6. The calendar count circuit 4 sequentially counts "day" and "month" as calendar data in accordance with a carry signal from the time count circuit 3. The calendar data produced from the calendar count circuit 4 is supplied to the display switch control circuit 5. Alarm setting data in the time alarm circuit 6 is also supplied to the display switch control circuit 5.

An operation signal derived from a display switch S1 is applied to a selection circuit 7 comprised of a scale-of-3 counter to step the contents of the selection circuit 7. The contents of the selection circuit 7 is supplied to the display switch control circuit 5. In the display switch control circuit 5, upon receipt of the contents, the display switch control circuit 5 selectively applies the output data from the time count circuit 3, the calendar output 4 or the time alarm circuit 6 to a decoder 9 in accordance with the contents of the selection circuit 7. The output signal from the decoder 9 is applied to a display section 10 where it is displayed. The contents of the selection circuit 7 is also applied to a setting circuit 8. The data selected through the operation of the display switch $S_1$ may be corrected by a setting switch $S_2$.

The calendar count circuit 4 is comprised of a decimal day counter **4*a* for counting the units digit of a day, a scale-of-4 counter 4*b* for counting the tens digit of the day, and a scale-of-12 counter 4*c* for counting a month. The units-day counter 4*a*, the tens-day counter 4*b*, and the month counter 4*c* are a 4-bit counter, a 2-bit counter and a 4-bit counter, respectively. The first to fourth bits of the day counter 4*a* correspond to a "8,4,2,1" binary code. The output signals at the first and third bits of the day counter 4*a* are directly applied to an AND gate 13. The output signals at the second and fourth bits are applied to the AND gate 13, through inverters 11 and 12, respectively. Therefore, when the contents of the units-day counter 4*a* is "1010" ("5" in the decimal system), the AND circuit 13 produces a signal of "1". The output signal from the second bit of the tens-day counter is directly applied to an AND gate 15, while the output signal from the first bit is applied to the same, through an inverter 14. When the contents of the tens-day counter 4b is "01" ("2" in the decimal system), the AND circuit 15 produces a signal of "1". The output signals at the 3rd and 4th bits of the month counter 4c are directly applied to an AND gate 18 while the output signal at the 1st and 2nd bits are applied through inverters 16 and 17 to the AND circuit 18. When the contents of the month counter 4c is "0011" ("12" in the decimal system), the AND circuit 18 produces a signal of "1". The output signals from the AND circuit 13, 15, and 18 are applied to an AND circuit 19. With this connection, when the contents of the units-day counter 4a is "5" in the decimal system, the contents of the tens-day counter 4b is "2", and the contents of the month counter 4c is "12", that is, when it is "Dec. 25", the AND circuit 19 produces a signal of "1". The output signal from the AND circuit 19 is applied to AND circuits 21 and 22, through an inverter 20. An alarm signal b is applied from the alarm circuit 6 to the AND circuit 21. A time signal a is applied from the time count circuit 3 to the AND circuit 22. The output signal from the AND circuit 19, together with the alarm signal b from the alarm circuit 6, is directly applied to an AND circuit 23. The same signal, together with the time signal a from the time count circuit 3, is applied to an AND circuit 24, similarly. The output signals from the AND circuits 21 and 22 are directly applied to an initial address generating circuit 26. The output signals from the AND circuits 23 and 24 are applied to the initial address generating circuit 26, via an OR circuit 25. For producting a musical piece in accordance with the output signals from the AND circuits 21 and 22 and an OR circuit 27, the initial address generating circuit 26 applies the initial address data corresponding to the musical piece to an address section 29 for specifying an address of a musical tone code memory section 28, through an OR circuit 27. The musical tone code memory section 28, comprised of a read only memory (ROM), fixedly stores various codes composing the musical piece, and when addressed by an address section 29, produces in parallel a note duration code signal A, a scale code signal B and a signal C for designating the next address of the memory section per se. The note duration code signal A is applied to a note duration control circuit 30. The note duration control circuit 30 applies an output signal as a gate signal to one of the input terminals of an AND circuit 31 after a time period corresponding to the note duration signal A. The scale code signal B is applied to a decoder 32. After stored in a buffer 33, the next address designating signal C is applied to the other input terminal of the AND circuit 31. When receiving an output signal from the note duration control circuit 30, the AND circuit 31 produces the next address designating signal to the address section 29 via the OR circuit 27. A reference frequency signal $\phi$ from the oscillating circuit 1 is also applied to a scale frequency signal generating circuit 34. The scale frequency signal generating circuit 34 frequency-divides the reference frequency signal into clock signals with frequencies corresponding to the respective scales "C", "D", "E", . . . . These clock signals are applied to a scale frequency signal selection circuit 35. In accordance with the contents decoded by the decoder 32, the scale frequency signal selection circuit 35 selects the clock signal corresponding to the scale decoded from those clock signals and applies the clock signal selected to a sounding section 36** which in turn produces a musical tone as an alarm sound.

The operation of the embodiment thus constructed will be described. The reference frequency signal outputted from the oscillating circuuit 1 is applied to the frequency divider 2 where it is frequency-divided into a signal of one-second period and is applied to the time count circuit 3 where time data is counted. The time data from the time count circuit 3 is supplied to the display switch control circuit 5. Normally, the time data is selected by the selection circuit 7 and the selected one is applied to the decoder 9 and then is displayed by the display section 10. The time count circuit 3 produces a carry signal of a 24-hour period (1 P/D) to the calendar count circuit 4 where the calendar data such as day and month are counted.

When the calendar data in the calendar count circuit 4 is other than "Dec. 25", the AND circuit 19 produces a signal of "0" which is in turn applied to the AND circuits 21 and 22 via the inverter 20. The time signal a, which is produced every noon from the time count circuit 3, is applied to the initial address generating circuit 26 through the AND circuit 22. As a result, in the musical tone code memory section 28, an initial address where a code of a musical piece used as a usual time signal is stored, is specified. Accordingly, the musical tone code memory section 28 produces a note duration code A, a scale code B and a next address designating signal C, those signals relating to the first musical tone of those composing the specified musical piece. The scale code B is applied to the decoder 32. Accordingly, the scale frequency signal selection circuit 35 selects a clock signal defined by the contents of the decoder 32 from those clock signals derived from the scale frequency signal generating circuit 34, and applies the selected one to the sounding section 36. In this way, the first musical tone of the musical piece is sounded. The first musical tone is continuously sounded until the given time period corresponding to the note duration code A is elasped in the note duration control circuit 30. When the output signal is produced from the note duration control circuit 30, the AND circuit 31 is enabled to allow the next address designating signal C to go to the address section 29. Then, the address section 29 addresses the musical tone code memory section 28 where it is converted into the next address. As a result, the musical tone code memory section 28 produces a note duration code A, a scale code B and the next address designating signal C, which relate to the second musical tone of the musical piece. In this way, the sounding section 36 produces the second musical tone. Subsequently, similar operations are repeated to produce the musical piece of the time signal. When the time data in the time count circuit 3 is other than "Dec. 25" at the alarm time, the time alarm circuit 6 produces the alarm signal b. The alarm signal b is applied to the initial address generating circuit 26, through the AND circuit 21 to which the signal of "0" from the AND circuit 19 is applied through the inverter 30. Therefore, the initial address generating circuit 26 produces the initial address of the musical piece used as the time alarm sound to produce the normal time alarm musical piece. When the calendar data of the calendar count circuit 4 is "Dec. 25", the units day counter 4a has "1010" ("5" in the decimal system), the tens day counter 4b has "01" ("2" in the decimal system), and the month counter 4c has "0011" ("12" in the decimal system). Therefore, the AND circuits 13, 15 and 18 produce signals of "1" which are in applied to the AND circuit 19. Upon receipt of the signal, the AND circuit 19 produces a signal of "1" for transfer to the AND circuits 23 and 24. Further, a signal of "0" is applied to the AND circuits 21 and 22, via the inverter 20. At this time, when the time counted by time count circuit 3 reaches the alarm time of the time alarm circuit 6, the alarm signal b is applied to the AND circuits 21 and 23. For this reason, a signal of "1" is produced from the AND circuit 23 and is applied to the initial address generating data to provide a usual time signal melody produced when it is at noon on "Dec. 25" or at the alarm time, or a musical piece different from that at the time alarm, for example, "Jingle Bell", is applied from the initial address generating circuit 26 to the address section 29 of the musical tone code memory section 28, via the OR circuit 27. The result is the sounding of the musical piece "Jingle Bell".

It is evident that the specific day which is "Dec. 25" in the above-mentioned embodiment, may be set to any suitable data, for example, "Jan. 1" as a holiday. The electronic device of the present invention can tell a specific day by sounding a melody related to it, if the specific day such as Christmas or other holidays, is not previously set.

Figure 2A:
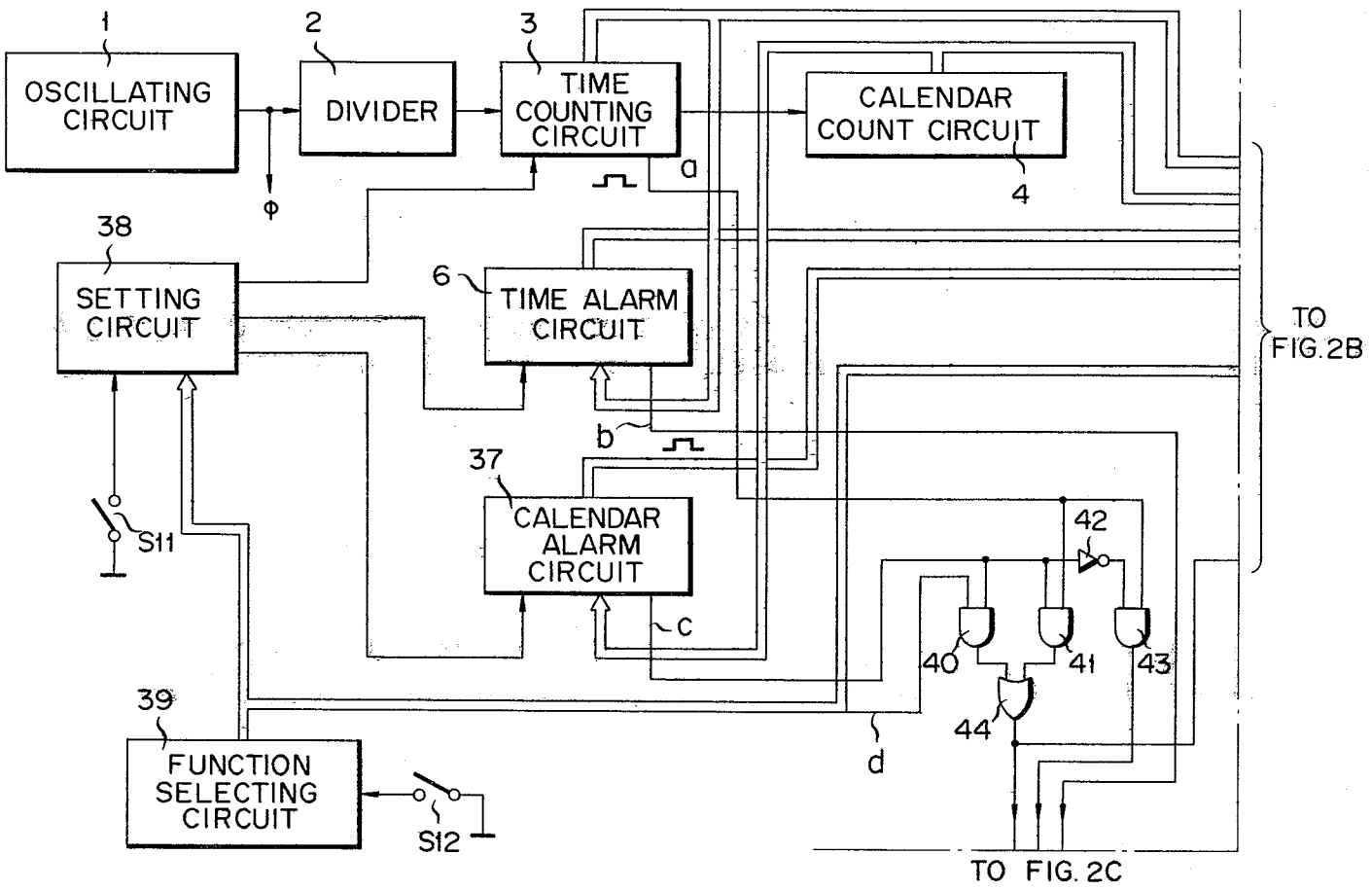
FIGS. 2A to 2C cooperate to form a circuit arrangement of another embodiment of the present invention.
Figure 2B:
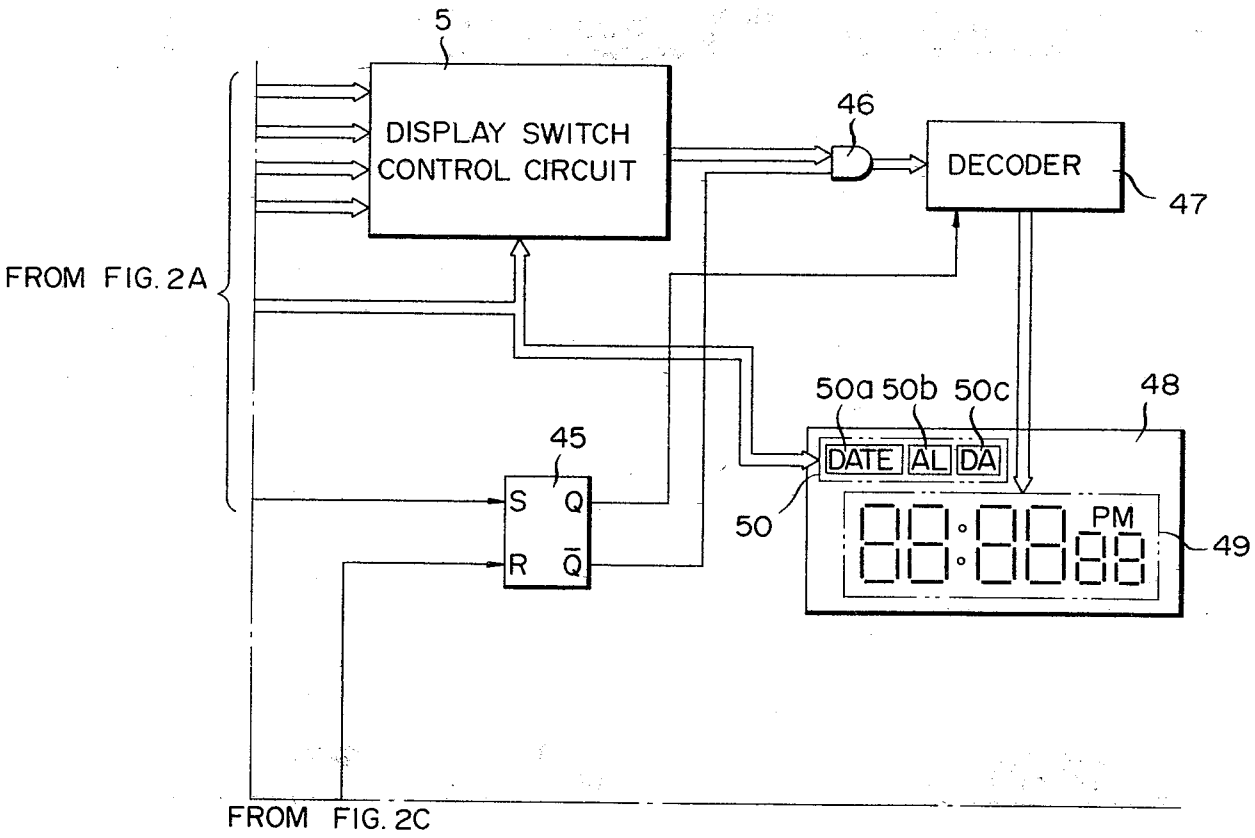

Turning now to FIG. 2, there is shown another embodiment of the present invention. In FIG. 2. like reference symbols are used for designating like or equivalent portions or parts in FIG. 1, for simplicity of explanation. In FIG. 2, the electronic device is so designed that desired calandar alarm data such as day and month may be previously set in a calendar alarm circuit 37 by a setting circuit 38. The calendar data obtained from the calendar count circuit 4 is supplied to the calendar alarm circuit 37. So long as the calendar data in the calendar count circuit 4 is coincident with the calendar alarm setting data, it produces the alarm signal C continuously. A switch $S_{11}$ is used for setting time or a date in the time count circuit 3, the calendar count circuit 4, the time alarm circuit 6 and the calendar alarm circuit 37. A function selecting switch $S_{12}$ selects a function to step the contents of a function selecting circuit 39 as a scale-of-4 counter and to display it by the display section. The data in the count circuit 3, the calendar count circuit 4, the time alarm circuit 6, and the calendar alarm circuit 37 are selectively displayed by the switch $S_{12}$ and the data selected is corrected by the switch $S_{11}$. In this way, time or date is set in the time count circuit 3, a calendar count circuit 4, the time alarm circuit 6 and the calendar alarm circuit 37. A detecting signal c outputted from the calendar alarm circuiut 37 is applied as a gate control signal to one of the input terminals of each AND circuit 40 and 41 and to one of the input terminal of an AND circuit 43 by way of an inverter 42. The other input terminal of the AND circuit 40 is supplied with a one-shot d produced from the function selecting circuit 39 when time display is switched to date display by operating the switch $S_{12}$. An alarm signal produced every noon from the time count circuit 3 is applied to the other input terminals of the AND circuits 41 and 43. The output signals from the AND circuits 40 and 41 are applied to the set input terminal S of a flip-flop 45 (see FIG. 2B). The output signal from the output $\overline{Q}$ of a flip-flop 45 is applied as a gate control signal to an AND circuit 46 of which one input is supplied with the output data from the display switch circuit 5. The output data from the AND circuit 46 is decoded by the decoder 47 and then it is applied to a digital section 49 of a liquid crystal display section 48. When receiving the output signal from the output Q of the flip-flop 45, the decoder 47 applies an output signal representing "HAPPY" to a digital display section 49. The digital display section 49 has six digits figures each formed by segments arranged like a numeral 8. The liquid crystal display unit 48 is further provided with the digital display section 49 and a functional display section as generally designated by 50. The function display section 50 is provided with a "DATE" display member **50*a*, an "AL" display member 50*b*, and a "DA" display member 50*c*. The display members 50*a* to 50*c* are driven for display in accordance with the output contents from the functional selecting circuit 39**.

Figure 2C:
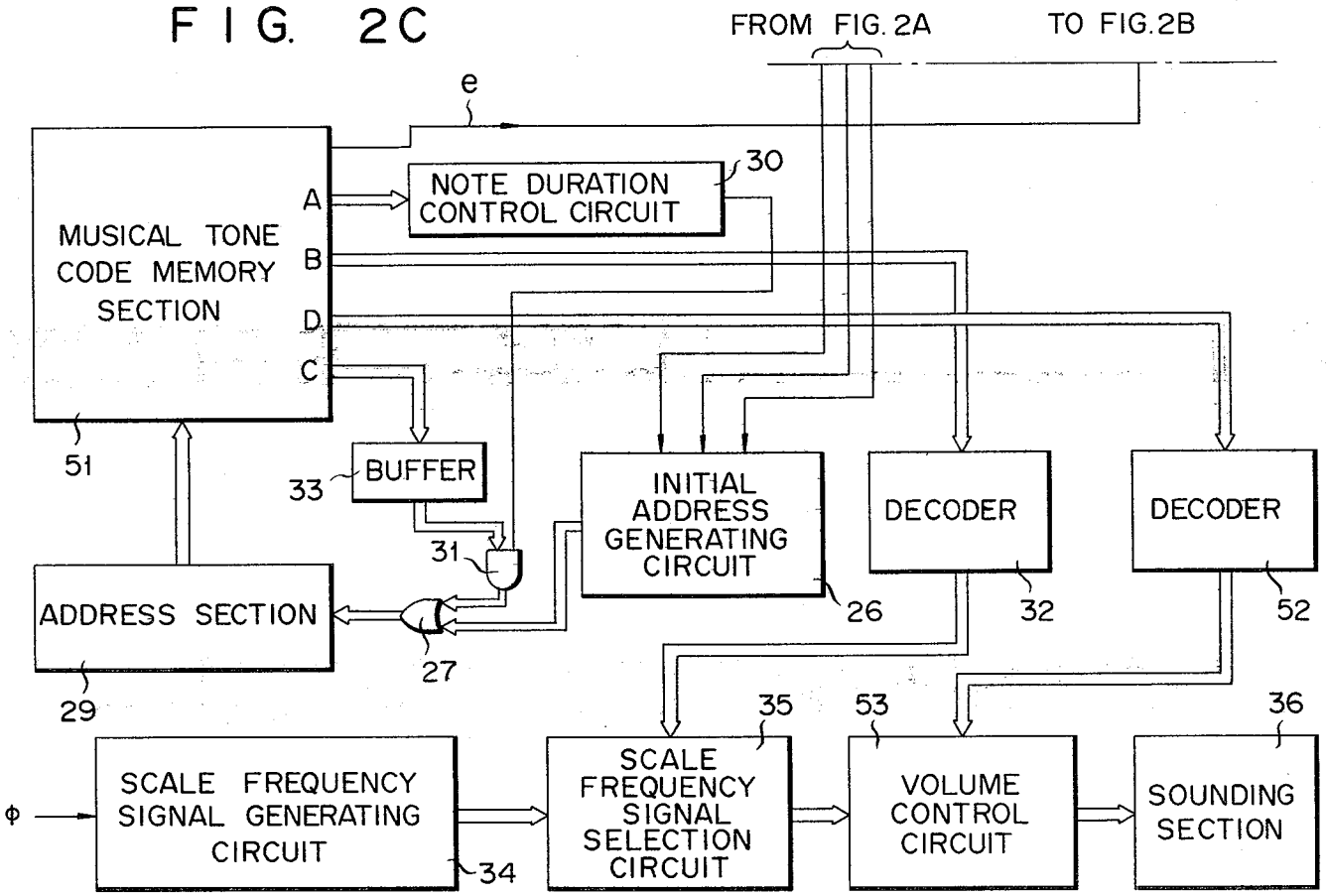

The output signals from the OR circuit 44 and the AND circuit 43, and the output signal from the time alarm circuit 6 are applied to the initial address generating circuit 26 (see FIG. 2C). The initial address generating circuit 26 applies different initial address data to an address section 29 for designating the musical tone code memory section 5 via the OR circuit 27 in accordance with the output signals from an OR circuit 44 and an AND circuit 43 and the alarm signal b from the time alarm circuit 6. The musical tone code memory section 51 is constructed by a ROM which fixedly stores various codes composing a musical piece. When addressed by the address section 29, it produces in parallel a note duration code A, a scale code B, a volume code D and a signal for designating the next address of the memory section 51 per se. The note duration code A is supplied to a note duration control circuiut 30. The scaled code B is supplied to a decoder 32 and the volume code D is also applied to a decoder 52. After the address designating signal C is temporarily stored in the buffer 33, it is supplied to the other input terminal of an AND circuit 31. When an output signal is produced from the note duration control circuit 30, the AND circuit 31 applies the next address designating signal C to the address section 29 via the OR circuit 27. At the completion of the musical piece, the musical tone code memory section 51 produces an end signal e which in turn is applied to the reset input terminal R of the flip-flop 45.

The reference frequency signal $\phi$ from the oscillating circuit 1 is also applied to a scale frequency signal generating circuit 34 which in turn produces clock signals and supplies the produced ones to a scale frequency signal selection circuit 35. The clock signal from the scale frequency signal selection circuit 35 is supplied to a volume control circuit 53. The volume control circuit 53 controls a volume of the clock signal outputted from the scale frequency signal selection circuit 35 in accordance with the contents of decoder 52. Upon receipt of the signal outputted from the volume control circuit 53, a given musical tone is produced as an alarm sound from a sounding section 36.

Figure 3:
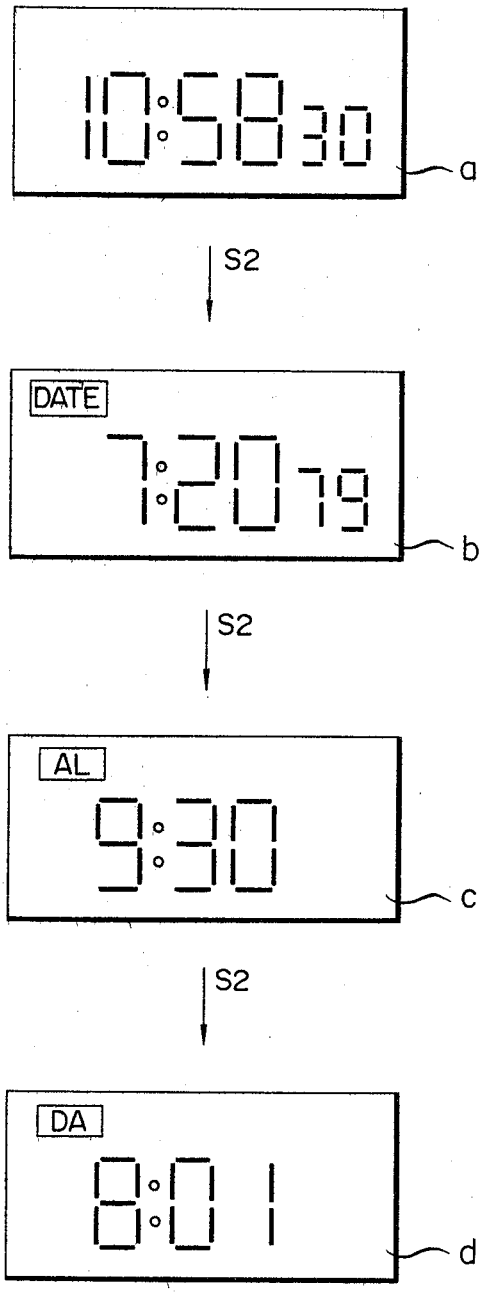
FIG. 3 illustrates some display examples of a liquid crystal display device 48 shown in FIG. 2.
Figure 4:
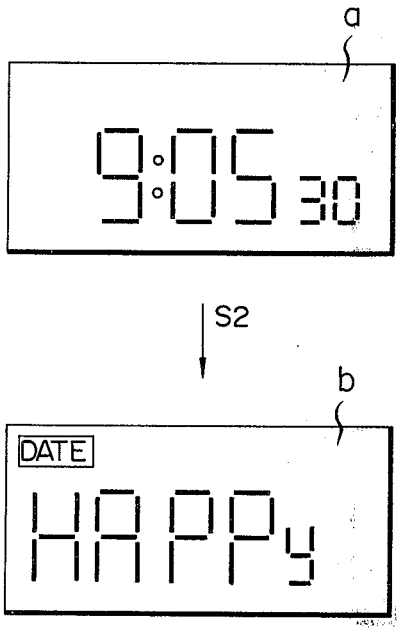
FIG. 4 illustrates other display examples of the liquid crystal display device 48.
Figure 5:
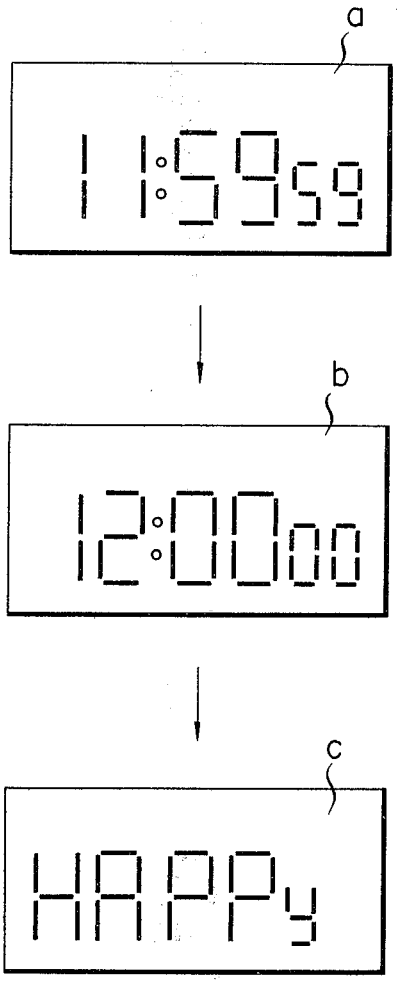
FIG. 5 illustrates additional display examples of the liquid crystal display device.

FIGS. 3, 4 and 5 show display states of the electronic timepiece thus constructed. In a normal state, the flip-flop 45 is reset by the end signal e from the musical tone code memory section 51 and the output signals appears at the output Q. Further, the contents of the function selection circuit 39 is "0". In this condition, the AND circuit 46 is enabled, so that the time data from the time count circuit 3 is supplied to the decoder 47, through the display switch control circuit 5 and the AND circuit 46. As a result, the digital display section 49 displays the present time, for example, "10:58:30", as shown in a of FIG. 3.

When the function selection switch $S_{12}$ is operated to set the contents of the function selection circuit 39 to "1", the display switch control circuit 5 produces the calendar data in the calendar count circuit 4 and applies it through the AND circuit 46 to the decoder 47. As a result, in the digital display section 19, the present calendar data such as "June 20, '79" is displayed by the digital display section 19, as shown in b of FIG. 3. In the functional display section 50, the "DATE" display member 50*c* is driven to indicate the calendar display mode, as shown in b of FIG. 3.

Then, by operating the function selection switch $S_{12}$, the contents of the function selection circuit 39 is set to "2". As a result of the switch operation, the display switch control circuit 5 produces alarm setting data to the time alarm circuit 6 and applies it to the decoder 47 through the AND circuit 46. As a result, the digital display section 49 displays the alarm setting data, for example, "9:30", as shown in c of FIG. 3. In the function display section 50, the "AL" display member 50*a* is driven to indicate the time alarm mode, as shown in c of FIG. 3.

Similarly, when the contents of the function selection circuit 39 is stepped to set it to "3", the display switch control circuit 5 produces calendar alarm setting data of the calendar alarm circuit 37 and applied it to the decoder 47, through the AND circuit 46. As a result, the digital display section 49 displays the calendar alarm setting data, for example, "August 1", as shown in d of FIG. 3. The function display section 50 drives the "DA" display member 50*c*, as shown in d of FIG. 3 and indicates the calendar alarm display mode.

In this way, as shown in a of FIG. 4, in a situation where the digital display section 49 displays the normal time, when the calendar data from the calendar count circuit 4 is coincident with the calendar alarm, that is, the calendar data reaches "August 1", the calendar alarm circuit 37 produces the alarm signal c which keeps high level s long as the coincident is continued. Under this condition, the function selection switch $S_{11}$ is operated and the contents of the function selection circuit 39 are stepped for the purpose of displaying the present date. Through the switch operation, the function selection circuit 39 produces the one-shot signal d. AS a result, the AND circuit 40 produces a one-shot output signal which in turn is applied to the set input terminal S via the OR circuit 44 and also to the initial address circuit 26. Then, the flip-flop 45 is set of which the output state is inverted, with the result that its output Q provides a signal of "1" while its output $\overline{Q}$ provides a signal of "0". Accordingly, the AND circuit 46 is closed and the decoder 47 supplies an output signal corresponding to "HAPPY" to the digital display section 49. The result is that the digital display section 49 displays "HAPPY" by using the display members of five figures, as shown in b of FIG. 4. Also in the function display section 50, the "DATE" display member 50*a* is driven to indicate the calendar display mode. The output signal from the OR circuit 44 is applied to the initial address generating circuit 26. Accordingly, the initial address generating circuit 26 produces address data and applies it to the address section 29 by way of the OR circuit 26. Then, the address section 29 designates a given address of the musical tone code memory section 51 in accordance with the address data. Upon the addressing by the address section, the musical code memory section 51 produces a note duration code A, a scale code B and a volume code D, which relate to the first musical tone of those composing a musical piece such as "Happy Birthday", and additionally produces a signal C for designating the next address of the memory section 51 per se. The scale code B is supplied to the decoder 32 and the volume code D is supplied to the decoder 52. Therefore, the scale frequency signal selection circuit 35 selects a clock signal in accordance with the contents of the decoder 32 from those clocks from the scale frequency signal generating circuit 34 and applies it to the volume control circuit 53. The volume control circuit 53 controls the volume in accordance with the contents of the decoder 52 and applies it to the sounding section 36. In this way, the first musical tone of the song "Happy Birthday" is continuously sounded until a given time period in accordance with the note duration code A has elapsed in the note duration control circuit 30. When the output signal from the note duration control circuit 30 is produced, the AND circuit 31 is enabled to allow the next address designating signal C to be supplied to the address section 29, so that the musical tone code memory section 51 produces a note duration code A, a scale code B, a volume code D and a signal C for designating the next address thereof, which relates to the second tone of the musical piece. The result is the sounding of the second musical tone by the sounding section 36 with a given volume. Subsequent similar operations perform the musical piece of the "Happy Birthday". After completion of the musical piece, the musical tone code memory section 51 produces an end signal e to reset again the flip-flop 45. Therefore, the output state of the flip-flop 45 is inverted to produce a signal of "1" at the output Q and a signal of "0" at the output $\overline{Q}$. In turn, the display "HAPPY" shown in b of FIG. 4 disappears and the normal time shown in a of FIG. 4 is displayed.

In a condition that the alarm signal c is produced from the calendar alarm setting circuit 37, when the time data of the time count circuit 3 is changed from "11:59:59" shown in a of FIG. 5 to "12:00:00" shown in b of FIG. 5, for example, the time count circuit 3 produces an alarm signal a. Accordingly, the AND circuit 41 produces a one-shot signal to set the flip-flop 45 through the OR circuit 44. Therefore, the digital display section 49 displays "HAPPY", as shown in c of FIG. 5. At the same time, the output signal from the OR circuit 44 is applied to the initial address generating circuit 26, too. Accordingly, the sounding section 36 performs the "Happy Birthday". Upon the completion of the performance, the "Happy" of the digital display section 49 is erased. On a date of the calendar alarm preset, when noon is detected, the digital display section 49 displays the "HAPPY" while at the same time the "Happy Birthday" is performed. Accordingly, when the setting date of the calendar alarm is a birthday of an operator, he can know his birthday by the display and the performance. This feature is unique.

On a day other than the day set as the calendar alarm, when the alarm detecting signal from the calendar alarm circuit 7 is at low level, the signal inverted by the inverter 42 is applied to the AND circuit 43. Under this condition, the AND circuit 43 produces a one-shot output signal in accordance with the one-shot signal a produced every noon from the time count circuiut 3 and is applied to the initial address generating circuit 26. Then, the initial address generating circuit 26 produces address data different from the above-mentioned one and is applied to the address section 29. As a result, the musical tone code memory section 51 produces musical tone signals (a note duration code A, a scale code B and a volume code D) which compose a musical piece different from the above-mentioned one, "Happy Birthday". The musical tone code memory section 51 performs an address conversion in accordance with the next address designating signal C to sequentially produce the respective musical codes. The result is the sounding of a given musical piece as a time signal.

When the time alarm circuit 6 detects a coincidence of the count data from the time count circuit with the time alarm setting data, the one-shot signal b is outputted and is applied to the address generating circuit 26, and finally is sounded as a given musical piece alarm sound. This operation is performed regardless of the setting data of the calendar alarm.

While the above-mentioned embodiment is so designed that when it is switched to the calendar display mode on the specific data preset, or at the time signalling time, the calendar alarm is reported by the display "HAPPY", this may be given at a specific time on the specific day.

In the above-mentioned embodiment, the time alarm is reported by the same display or sounding regardless of the specific day preset. This may be modified such that the display of the "HAPPY" and the sounding of the specific musical sound are performed on only the specific day.

In another modification, another usual calendar is provided in addition to the calendar providing the "HAPPY" display. Dates of the birthday and the marriage day are stored in the calendar alarm of the "HAPPY" display and the other dates in the usual calendar alarm.

Moreover, the present invention, which has been described by using the embodiment when it is applied to an electronic timepiece, may of course be applied to an alarm electronic device with alarm function such as a small-sized electronic calculator with a timepiece.

What is claimed is:

1. An electronic device with an alarm function comprising:

a source of reference clock signals;

time counting means for counting said reference clock signals from said source to provide time data;

display means for displaying said time data from said time counting means;

date counting means for counting a one-day signal produced from said time counting means to obtain date data;

a time alarm circuit for producing a first alarm sound generation instruction signal each time the time data produced from said time counting means reaches an alarm time;

alarm sound generating means coupled to said time alarm circuit for generating a predetermined alarm sound when the first alarm sound generation instruction signal is received, said alarm sound generating means being capable of generating a plurality of alarm sounds;

specific date detecting means coupled to said date counting means for detecting that the date data obtained by said date counting means reaches a specific date and for producing a specific date signal;

inhibiting means for inhibiting the supply of said first alarm sound generating instruction signal to said alarm sound generating means when said specific date signal is delivered from said specific date detecting means; and alarm sound generation control means for supplying a second alarm sound generation instruction signal to said alarm sound generating means in place of said first alarm sound generation instruction signal, said alarm sound generating means being responsive to said second alarm sound generation instruction signal to generate an alarm sound which is different from said predetermined alarm sound.

2. The electronic device of claim 1, wherein said alarm sound generating means includes external operating means for setting an alarm time; and alarm time storing means for storing the alarm time set by said external operating means; and wherein when said time data from said time counting means is coincident with the stored alarm time, an alarm signal is produced.

3. The electronic device of claim 2, wherein said alarm time is noon (00).

4. The electronic device of claim 1, wherein said specific date detecting means includes means for detecting a specific day when date data of said date counting means reaches a specific preset day.

5. The electronic device of claim 1, wherein said specific date detecting means includes external operating means for setting a specific day; and specific day storing means for storing the specific day set by said external operating means of said specific day detecting means; and wherein when said date data from said date counting means reaches the specific day, the specific day is detected.

6. The electronic device of claim 1 wherein said display means includes:

a display unit with at least five digits, each digit having display segments arranged to represent the numeral

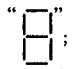

and display control means coupled to said spcific date detecting means for displaying "HAPPY" by the display segments of at least five digits of said display unit at said alarm time when said specific date detecting means detects that said date data of said date counting means becomes identical with the data representing a specific day.

7. The electronic device of claim 2, wherein said display means includes:

a display unit with at least five digits, each digit having display segments arranged to represent the numeral

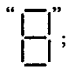

and display control means coupled to said specific date detecting means for displaying "HAPPY" by the display segments of at least five digits of said display unit at said alarm time when said specific date detecting means detects that said date data of said date counting means becomes identical with the data representing a specific day.

8. The electronic device of claim 3, wherein said display means includes:

a display unit with at least five digits, each digit having display segments arranged to represent the numeral

"8";

and display control means coupled to said specific date detecting means for displaying "HAPPY" by the display segments of at least five digits of said display unit at said alarm time when said specific date detecting means detects that said date data of said date counting means becomes identical with the data representing a specific day.

9. The electronic device of claim 4, wherein said display means includes:

a display unit with at least five digits, each digit having display segments arranged to represent the numeral

"8";

and display control means coupled to said specific date detecting means for displaying "HAPPY" by the display segments of at least five digits of said display unit at said alarm time when said specific date detecting means detects that said date data of said date counting means becomes identical with the data representing a specific day.

10. The electronic device of claim 5, wherein said display means includes:

a display unit with at least five digits, each digit having display segments arranged to represent the numeral

"8";

and display control means coupled to said specific date detecting means for displaying "HAPPY" by the display segments of at least five digits of said display unit at said alarm time when said specific date detecting means detects that said date data of said date counting means becomes identical with the data representing a specific day.

* * * * *

UNITED STATES PATENT AND TRADEMARK OFFICE

CERTIFICATE OF CORRECTION

PATENT NO. : 4,427,299

DATED : January 24, 1984

INVENTOR(S) : Minoru HASEGAWA

It is certified that error appears in the above-identified patent and that said Letters Patent is hereby corrected as shown below:

COLUMN 3, line 30, after "For" change "producting" to --producing--;

COLUMN 5, line 48, after "calendar alarm" change "circuiut" to --circuit--;

COLUMN 6, line 2, change "six digits figures" to --six digits or figures--;

COLUMN 7, line 35, after "keeps high" change "level s long" to --level so--.

Signed and Sealed this

Tenth Day of July 1984

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,427,299

DATED : January 24, 1984

INVENTOR(S) : Minoru Hasegawa

It is certified that error appears in the above-identified patent and that said Letters Patent is hereby corrected as shown below:

COLUMN 3, line 30, after "For" change "producting" to --producing--;

COLUMN 5, line 48, after "calendar alarm" change "circuiut" to --circuit--;

COLUMN 6, line 2, change "six digits figures" to --six digits or figures--;

COLUMN 7, line 35, after "keeps high" change "level s long" to --level so long--.

This certificate supersedes certificate of correction issued July 10, 1984.

Signed and Sealed this

*Twenty-second* Day of *October 1985*

[SEAL]

*Attest:*

*Attesting Officer*

DONALD J. QUIGG

*Commissioner of Patents and Trademarks—Designate*